US008695793B2

(12) United States Patent
Saggar et al.

(10) Patent No.: US 8,695,793 B2
(45) Date of Patent: Apr. 15, 2014

(54) FLEXIBLE STABLE EASILY OPENED PACKAGE

(75) Inventors: Ravi Saggar, Blue Ash, OH (US); Norman Henry Tiilikka, West Chester, OH (US); Dana Paul Gruenbacher, Fairfield, OH (US); Joshua James Norman, Cincinnati, OH (US); Philip Andrew Sawin, Hamilton, OH (US); Timothy Jay Rudisell, Jr., Cincinnati, OH (US); Somarly Mariana Lira, Deerfield, OH (US); Denise Ann Tingle, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1438 days.

(21) Appl. No.: 10/971,636

(22) Filed: Oct. 22, 2004

(65) Prior Publication Data

US 2006/0086627 A1 Apr. 27, 2006

(51) Int. Cl.
*B65D 30/16* (2006.01)
*B65D 83/08* (2006.01)

(52) U.S. Cl.
USPC ..... 206/233; 206/494; 206/812

(58) Field of Classification Search
USPC ..... 206/233, 812, 204, 738, 494, 581; 383/33, 34; 220/640; 221/64; 190/106; 150/120, 126
See application file for complete search history.

(56) References Cited

U.S. PATENT DOCUMENTS

| | | | | | |
|---|---|---|---|---|---|
| 2,123,454 | A | * | 7/1938 | Doppelt | 190/114 |
| 2,346,563 | A | * | 4/1944 | Doppelt | 190/122 |
| 2,561,042 | A | * | 7/1951 | Arnold et al. | 190/119 |
| 4,082,216 | A | * | 4/1978 | Clarke | 229/164.1 |
| 4,312,431 | A | * | 1/1982 | Corey | 190/104 |
| 4,570,820 | A | * | 2/1986 | Murphy | 221/34 |
| 4,790,436 | A | | 12/1988 | Nakamura | |
| 4,948,266 | A | * | 8/1990 | Bencic | 383/34 |
| 5,044,774 | A | * | 9/1991 | Bullard et al. | 383/34.1 |
| 6,092,687 | A | | 7/2000 | Hupp et al. | |
| 6,116,501 | A | | 9/2000 | Hupp et al. | |
| 6,164,821 | A | | 12/2000 | Randall | |
| 6,200,028 | B1 | * | 3/2001 | Buchanan | 383/63 |
| D451,279 | S | | 12/2001 | Chin | |

(Continued)

FOREIGN PATENT DOCUMENTS

| | | | |
|---|---|---|---|
| WO | WO 98/50279 | A2 | 11/1998 |
| WO | WO 00/12407 | A1 | 3/2000 |
| WO | WO 02/058524 | A2 | 8/2002 |

OTHER PUBLICATIONS

PCT International Search Report mailed Feb. 24, 2006. 4 pages.

*Primary Examiner* — Steven A. Reynolds
(74) *Attorney, Agent, or Firm* — Charles R. Matson; Laura L. Whitmer; Matthew P. Fitzpatrick

(57) ABSTRACT

Flexible, stable, and easily opened packages are disclosed. The package may be made from an outer highly flexible material defining a surface stable bag having a bottom four side walls and an opening portion. The opening portion may have a rigid reinforcing member attached to it. The rigid reinforcing member may be movable between a stable open and a stable closed configuration with one hand, allowing a user to open and close the package with one hand. Packages may be provided with moisture barrier properties to contain moisture containing personal articles, and dual bag configurations may be employed.

42 Claims, 4 Drawing Sheets

(56) References Cited

U.S. PATENT DOCUMENTS

| | | | | |
|---|---|---|---|---|
| 6,533,456 | B1 * | 3/2003 | Buchman | 383/63 |
| 6,604,651 | B2 * | 8/2003 | Amundson et al. | 221/47 |
| D499,021 | S | 11/2004 | Tiilikka et al. | |
| 2002/0064323 | A1 * | 5/2002 | Chin | 383/97 |
| 2002/0096533 | A1 | 7/2002 | Amundson et al. | |
| 2002/0096534 | A1 | 7/2002 | Amundson et al. | |
| 2003/0009858 | A1 | 1/2003 | Goldberg et al. | |
| 2003/0190097 | A1 | 10/2003 | Hajianpour | |

* cited by examiner

FLEXIBLE STABLE EASILY OPENED PACKAGE

FIELD OF THE INVENTION

This invention relates to flexible and easily openable packages. The packages are suited for any application, and in particular may be used to contain cleansing articles including moisture containing cleansing articles such as wet wipes, washmitts, or the like. The packages of the present invention may be flexible, may have a pleasant and soft feel, and may be amenable to both opening and closing with one hand operation.

BACKGROUND OF THE INVENTION

A wide variety of packages for articles of all different types are known in the art. Many of the features of such packages are dictated or influenced by the products or items they are designed to hold or carry or the uses to which they are expected to be put. For example, moisture containing cleansing articles such as wet wipes (such as wet baby wipes for the hands, face, or diaper change wiping) are often packaged in both hard plastic "tubs" or smaller, often flexible packages for more portable use. In the example of wet wipes, or other moisture containing articles, the articles may be dispensed with one hand (for example when holding a baby with the other hand). In such a case, it may be desirable to be able to open the package, dispense an article, and close the package with a single hand. Other possible desired attributes of a package for articles such as moisture containing cleansing articles are that it be flexible, compact, provide a moisture barrier, be pleasing to the touch, have low noise and surface friction properties, provide positive feedback when it transitions from an open to a closed (or "latched") configuration, that it be shelf-stable, remain open and closed without further action, and provide a sanitary dispensing area for articles. Of course some or all of these attributes may be desired for packages for uses other than containing moisture containing cleansing articles. These attributes and others may be desired in any combination. Packages having some of all of these attributes (and others not necessarily included on this list) may be desired for a wide variety of applications.

In particular, there may be a desire to have flexible, easily portable packages which can store articles and be opened and closed with a single hand. It may be desired that the package remains open once opened by a user without further application of force and that when closed by a user, the package remains closed. It may also be desired that such packages be re-usable if desired, such as by refilling them in whole or in part with additional articles such as moisture containing cleansing implements.

The packages of the present invention which are described in detail herein offer combinations of advantages and features not seen in previous packages, thereby making them suitable and superior for a wide variety of storing and transporting applications.

SUMMARY OF THE INVENTION

A package made according to the present invention may include a highly flexible bag material for containing one or more articles. The flexible bag material may be arranged so as to define a shelf stable bag having a bottom surface, four side surfaces, and a top opening portion. The package may also include a relatively rigid reinforcing member attached to the highly flexible, shelf stable bag material around the perimeter of the top opening portion. The reinforcing member may have an open configuration and a closed configuration. The reinforcing member may have opposed side portions and opposed hinge locations when in the open configuration. When the reinforcing member is in the open configuration, it may keep the top opening portion of the bag in a stable open position. The reinforcing member may be configured such that a user can with one hand transition the reinforcing member from the open configuration to the closed configuration and from the closed configuration to the open configuration. The bag material and the reinforcing member may be configured such when the reinforcing member is in the closed configuration the opposed sides of the reinforcing member abut to define a closed top portion of said bag. This results in a stable closed state for the package.

A package of moisture containing cleansing articles made according to the present invention may include one or more moisture containing cleansing articles and a flexible package material substantially surrounding the moisture containing cleansing articles. The package material may define a container having four side surfaces, a bottom surface, and a top opening. The package may also include a relatively rigid reinforcing member attached to the flexible package material around the perimeter of the top opening. The reinforcing member may have an open position and a closed position. The reinforcing member may keep the top opening portion of the container bag in a stable open configuration when the reinforcing member is in the open position. The reinforcing member may be configured such that a user with one hand can transition the reinforcing member from the open position to the closed position and from the closed position to the open position. The container and the reinforcing member may be configured such when the reinforcing member is in the closed position the flexible package material and the reinforcing member define a closed container resulting in a stable closed state for the package of moisture containing cleansing articles.

A package of moisture containing cleansing articles according to the present invention may include one or more moisture containing cleansing articles and a first flexible inner package material substantially surrounding the cleansing articles. The inner package material may have a vapor transmission rate of less than or equal to about 5 $g/m^2/day$. The package may have a second flexible outer package material substantially surrounding the inner package material. The second outer package material may have a vapor transmission rate in excess of that of said first inner package material.

The relatively rigid reinforcing member may have at least 10 times the resistance to bending as said flexible bag. This resistance to bending could also be at least 25 times that of the flexible bag material. This resistance to bending could also be at least 50 times that of the flexible bag material.

The flexible bag material may have a stiffness measured under the Stiffness of Fabric test of less than about 1000 $g_f$ or less than about 500 $g_f$ or less than about 250 $g_f$.

A package of the present invention may have a rigid reinforcing member which includes a latch mechanism. This latch mechanism may provide an audible signal indicating transition from the open to said closed position. This latch mechanism may provide a visual signal indicating transition from the open to the closed position.

A package of the present invention may have a relatively rigid reinforcing member which comprises thermoplastic material. This material may be chosen from the group consisting of polyethylene, polypropylene, and blends thereof.

A package of the present invention may include a highly flexible bag material which comprises a thermoplastic material. Such material may comprise a material chosen from the group consisting of polyethylene, polypropylene, and blends.

A package of the present invention may include a rigid reinforcing member with hinge locations comprising a living hinge.

A package of the present invention may include a rigid reinforcing member which has a generally rectangular configuration with each hinge location being located on one of the short sides of the rectangle. The hinge locations may be disposed adjacent the side surfaces of the bag when the rigid reinforcing member and said bag are in the closed configuration.

A package of the present invention may have a relatively rigid reinforcing member which defines a circumference in the open configuration which is substantially equal to or greater than the circumference of the bottom surface of said shelf stable bag defined by said flexible bag material.

A package of the present invention may have a relatively rigid reinforcing member provided with a flange element wherein at least a portion of the flange element overlaps at least a portion of the reinforcing member when the reinforcing member is in the closed position.

A package of the present invention may in the open position, define a dispensing area disposed generally above the one or more moisture containing cleansing articles. An interior baffle generally partitioning the one or more of said moisture containing cleansing articles from the dispensing area may also be provided. Such a baffle may also extend completely between opposed side walls of the container defined by the flexible package material, or such a baffle may not extend completely between such walls.

A package of the present invention may include one or more moisture containing cleansing articles contained within an inner wrapper. Such an inner wrapper may be disposed within the container defined by the flexible package material. Such an inner wrapper may have a vapor transmission rate of less than or equal to about 5 $g/m^2/day$.

A package of the present invention may have an inner wrapper attached to the flexible package material at least partially along the bottom of the container defined by the flexible package material.

A package of the present invention may have portions of a reinforcing member disposed generally adjacent two or more of the side surfaces of the container defined by the flexible package material when the reinforcing member is in the closed position.

A reinforcing member of a package of the present invention may be generally rectangular in configuration, or may be generally ovoid in configuration, or some other shape.

Moisture containing articles contained within packages of the present invention may be wet wipes, washmitts, facial cloths, or the like.

BRIEF DESCRIPTION OF THE DRAWINGS

While the specification concludes with claims particularly pointing out and distinctly claiming the subject matter which is regarded as forming the present invention, it is believed that the invention will be better understood from the following and forgoing description taken in conjunction with the accompanying drawings, in which:

DETAILED DESCRIPTION OF THE INVENTION

The following description describes, in detail, features of packages according to the present invention which may be provided. It should be noted that the design elements and attributes described herein are exemplary and the scope of the invention is determined solely by the appended claims. None of the features described for a particular execution or embodiment is necessarily critical to making or using a package of the claimed invention. The unique features and benefits of the packages described herein may be arranged and described in any desired combination.

Figure 1:
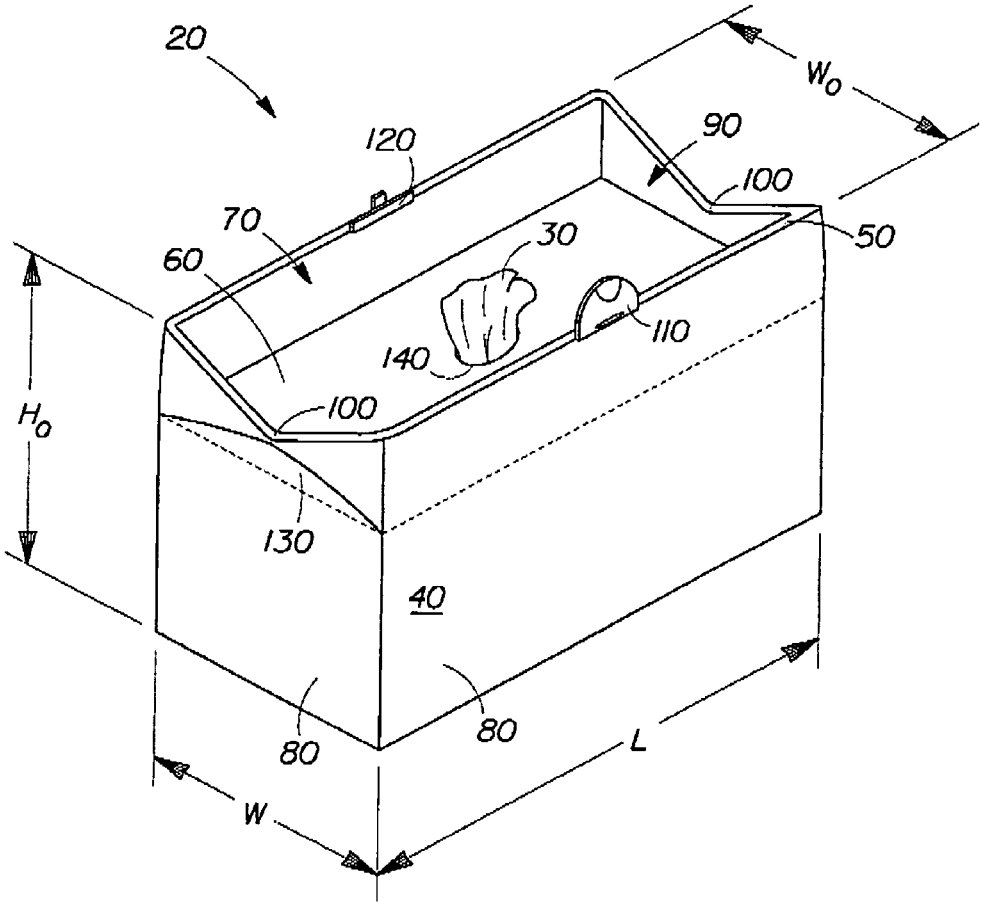
FIG. 1 shows a package according to the present invention in an open configuration.

FIG. 1 shows one possible configuration of package 20 according to the present invention. This execution is one possible configuration in which the package 20 is designed to hold and dispense moisture containing personal articles such as wet wipes 30. While FIG. 1 will describe the package 20 in terms of containing and dispensing wet wipes 30, this is not a requirement and any other articles may be stored, transported and retrieved from the package 20 as desired. Nevertheless, for the sake of convenience reference will be made to moisture containing articles, such as personal cleansing articles, and wet wipes 30 in particular in order to point out some of the additional features of the package 20 which may be included when such articles are held and dispensed by the package 20. For example, a wet wipe 30 (generally thought of as a substrate material having a cleaning composition disposed thereon that is used to cleanse body parts) may be packaged in a package 20 according to the present invention. While the material of a wet wipe such as wet wipe 30 is typically non-woven and made of synthetic compounds, woven materials as well as natural compounds, either woven or non-woven, may also be used. The substrate material is impregnated with a liquid or semi-liquid composition that may enhance cleaning, provide a smooth feeling, or perform some other function. The composition may include an emollient, a surfactant, an emulsifier, a soothing agent, a rheology modifier, a preservative or preservative system, water, or other components. For examples of each component and additional details regarding substrates and compositions for wet wipes, please see U.S. patent application Ser. No. 10/878,875, filed on Jul. 9, 2004, and entitled "A Composition for Wet Wipes that Enhances the Efficacy of Cleansing While Being Gentle to the Skin" assigned to the same assignee as the present disclosure, the disclosure of which is incorporated herein by reference. Such wet wipes may have a water content of 50% or more by weight.

Other moisture containing articles may be provided as a primarily "dry" product. For example, a child cleansing mitt may be provided, such as one of those disclosed in U.S. patent application Ser. No. 10/948,034, entitled "Child's Cleansing System", filed on Mar. 10, 2004, assigned to the same assignee as the present disclosure, the disclosure of which is also incorporated herein by reference. Accordingly, a moisture containing article may include a cleaning implement formed in the shape of a mitt and carrying a personal care composition. The mitt may be formed of natural fibers, synthetic fibers, or a combination thereof. Suitable natural fibers include, but are not limited to, cellulosic fibers such as wood pulp fibers, cotton, and rayon. Suitable synthetic fibers include fibers commonly used in textiles including, but not limited to, polyester and polypropylene fibers, polyethylene, polyether, PET, and combinations thereof. The personal care composition may be provided in the form of a paste or dry solid. While such "dry" compositions have a water content, it is typically no more than 10% by weight. Personal care compositions may include a surfactant and one or more adjunct ingredients, as disclosed in greater detail in the '034 application. Other similar "dry" products are disclosed in U.S. Pat. Nos. 5,620,694; 5,744,149; 5,972,361; 5,980,931; 6,063,397; 6,074,655; 6,132,746; 6,153,208; 6,280,757; 6,338,855; and 6,495,151.

As understood from the foregoing, the moisture containing article (such as wet wipe 30) has a water content. The article may be relatively dry (i.e., having a water content of less than 10%) or relatively wet (i.e., having a water content of 50% or more). While two examples are provided above, various alternative forms of the moisture containing article may be used in accordance with the present disclosure that may have other water content values. When a moisture containing article (especially a disposable, personal care related article) is desired to be packaged, it is often desirable that such packing include a sufficient barrier to vapor transmission. This may be desirable to prevent the article from being contaminated, from drying out (such as by evaporation) or from being prematurely exposed to high-humidity environments (such as in the case of a "dry" washmitt or "dry" makeup removal cloth contained in a bathroom). In the case of a "dry" article such as those described above it is appreciated that they may contain measurable moisture and that it may be desirable to keep excess moisture out of the article until release of some cleansing (or other) composition is desire. Therefore, a wide variety of moisture containing articles may be desirable to package in packages offering a barrier to vapor transmission. It should be appreciated, however, that such a barrier will not necessarily be required or desirable in all executions of packages of the present invention.

In the package 20 shown in FIG. 1 the package 20 may comprise as its basic components a flexible package material 40 and a reinforcing member 50. The flexible package material 40 may be made from a thermoplastic material and comprise any suitable flexible film from which a package structure may be made. Suitable materials for such flexible package material 40 include polyolefins, including polyethylene, polypropylene, low density polyethylene, low density polypropylene, high density polyethylene, high density polypropylene, or combinations of these. Other suitable materials may include polyester, polyvinylchloride, fabric, woven materials, cardboard, paper, and the like.

The package 20 shown in FIG. 1 may be constructed solely from a single layer of flexible package material 40 and a reinforcing member 50, or it may be constructed of more than one basic package layer. For example, an inner packaging material may be provided resulting in a "bag in a bag" type configuration. Such an inner packaging configuration could be useful, for example, to provide both an outer dispensing and carrying packaging into which a pre-packaged stack of wet wipes 30 or other articles (by way of "refill packs", for example) can be placed and replaced when empty. In another variation, an inner baffle or inner barrier may be provided which is attached at one or more locations to the flexible package material 40 (which in such a case would be the outer packaging material).

Any or all of the layers of material, and in particular the flexible package material 40 may be made in such a configuration so as to be flexible or highly flexible. By "flexible" or "highly flexible" it is meant that the film out of which the package material 40 is constructed will offer minimal resistance to bending and will tend to conform or deform in the presence of externally applied forces. In particular, the flexible package material 40 may exhibit sufficient flexibility so that it can move with and be conformed by the opening and closing action of the reinforcing member 50 as will be described in greater detail below. The flexibility of material which may be used as the flexible package material may be measured according to the Stiffness of Fabric Test which is described in greater detail in the Test Methods section, below. A flexible or highly flexible material suitable for use as the flexible package material 40 may have a peak load in grams-force ($g_f$) as measured under the Stiffness of Fabric test of less than about 250 $g_f$, or less than about 500 $g_f$ or less than about 1000 $g_f$. This combination of flexibility, shelf stability, and ease of operation (for example one-handed) offers advantages not seen in conventional or previously known packages. It will be appreciated by those of skill in the art that the Stiffness of Fabric Test can be employed on materials not commonly thought of as "fabrics" such as leather, synthetic leather, plastics, and other materials from which packages can be made.

As shown in FIG. 1, the basic arrangement of the flexible package material 40 in the package 20 is such that the flexible package material 40 surrounds the articles to be contained and dispensed—such as wet wipes 30. In this configuration, the flexible packaging material 40 may define a flexible package having four sides (such as sides 80), and bottom and an opening, such as opening 70. It is not necessary that the flexible package material 40 be constructed from a single piece. Multiple pieces of such flexible package material 40 can be combined to form the bag or container structure, and these can be made from the same material type or multiple material types.

While no particular size and shape of the resulting package is critical, the dimensions of the package 20 may be selected so as to result in a configuration which is shelf stable. By shelf stable it is meant that the package 20 will tend to remain upright when placed bottom surface down on a hard support surface and will not tend to tip or fall over. Such a shelf stable configuration may be desired when the package 20 is fully loaded with wet wipes 30 or other articles, when it is empty, or with any number of articles in between. The terms "shelf stable" and "surface stable" are intended to have the same meaning in this specification and may be used interchangeably.

In addition to the flexible package material 40, the package 20 shown in FIG. 1 also comprises a reinforcing member 50. In the embodiment shown in FIG. 1 this reinforcing member 50 is a rigid reinforcing member. While no particular level of rigidity is required, a rigid reinforcing member is taken to mean a member which offers more resistance to bending or deformation than the film comprising the flexible packaging material 40 as a whole.

The reinforcing member 50 may be, but need not be, comprised of a thermoplastic material. For example the reinforcing member 50 may be comprised of a high density polyethylene injection molded frame. The materials of the reinforcing member 50 and of the flexible package material 40 may be the same or similar and may be selected to be compatible with heat sealing of the reinforcing member 50 to the flexible package material 40. Of course, such a selection is not necessary and the reinforcing member can be made of any convenient or desired material.

Figure 1A:
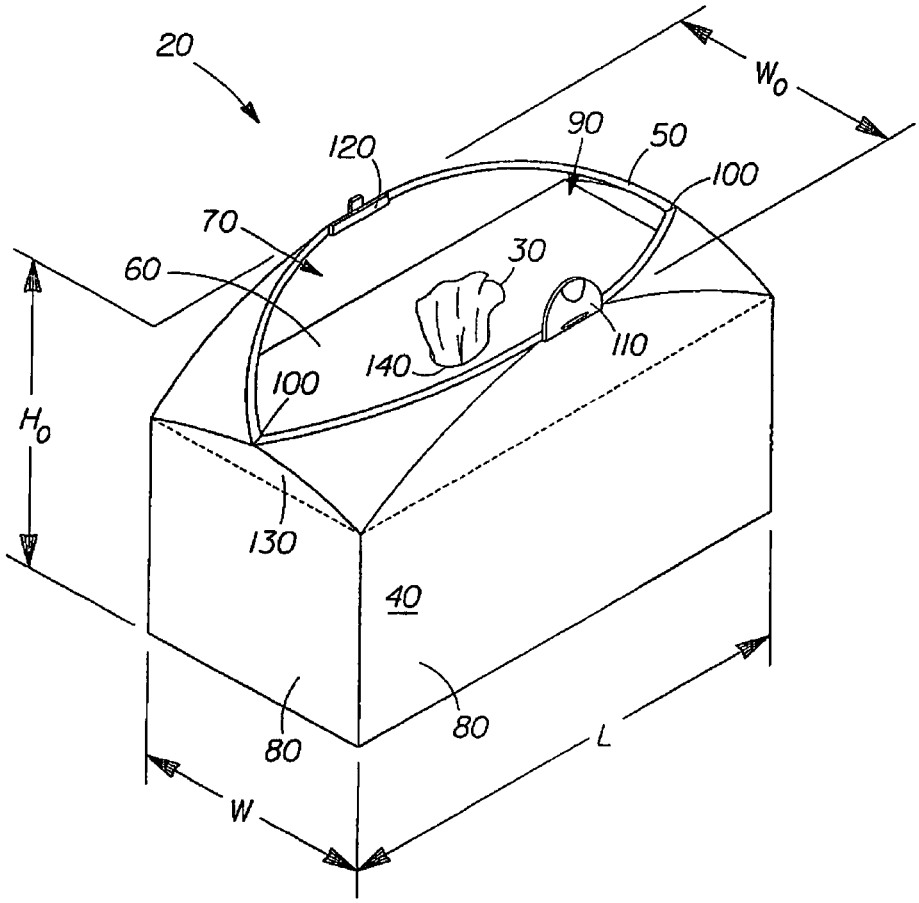
FIG. 1A shows a package embodiment including a relatively rigid reinforcing member that is generally ovoid in shape.

The reinforcing member 50 shown in FIG. 1 is generally of a rectangular configuration when in the open position. This is one possible design, but others are also possible and contemplated. For example, the reinforcing member 50 may have two semi-circular sides which open into a circular, elliptical, or ovoid configuration, as shown in FIG. 1A. Other shapes are also suitable. The package 20 shown in FIG. 1 shows the reinforcing member 50 completely surrounding the opening 70 defined by the flexible package material 40. The reinforcing member 50 may be attached or joined to the flexible package material 40 at the edge of the flexible package material 40 defining the opening 70. Such attachment may be accomplished by any suitable means such as heat sealing, adhesive, ultrasonic bonding, stitching, or any other convenient means.

As noted previously, it is not necessary that the package 20 be generally rectangular, or that the reinforcing member 50 generally have this rectangular shape. Nevertheless, because this is one possible shape shown by example in FIG. 1, some of the features of the package 20 of the present invention will be explained in greater detail with reference to such a rectangular configuration.

As shown in FIG. 1 the overall dimensions of package 20 may be selected to result in a configuration which is shelf stable both in the open and closed configuration. For example, in the configuration shown in FIG. 2, the package 20 may have an overall length dimension L of between about 70 and about 300, and may have a length L of about 186 mm. Similarly, the width dimension W may be between about 30 mm and about 200 mm, and may have a width W of about 91 mm. The height dimension in the closed configuration $H_c$ may be between about 30 and 150 mm and may have a closed height $H_c$ of from about 74 mm to about 100 mm. The $H_c$ dimension may be chosen to be sufficiently small in comparison to the base area (L*W) so as to result in an overall shelf stable configuration, even when the flexibility of the package material 40 is taken into account.

FIG. 1 shows the package 20 in its opened configuration. In the example shown in FIG. 1 the length and width dimensions (L and W), respectively, may be the same as those shown in FIG. 2. The open height $H_o$ of the package 20 may be greater than the closed height and this open height dimension may range from about 40 mm to about 200 mm, or may have a $H_o$ from about 130 mm to about 160 mm. $H_o$ may be from about 150% to about 200% of $H_c$. The opening of the reinforcing member 50 in the manner described may result in a volume change in the package 20 a whole. Specifically the volume of the package 20 in the open configuration may be greater than that of the package 20 when it is the closed configuration. In particular, the volume or even of the existence of the dispensing area 90 (described in more detail below) may change or increase when the package 20 is moved into the open configuration from the closed configuration.

For ease of description, the size of the base (that is the length L, the width W and the area resulting from their combination) will be referred to as the "footprint" of the package 20. As previously noted, flexible package material 40 is configured so as to define a container having four sides a bottom, and an opening 70. The dimensions of the opening 70 created by the flexible package material 40 may be the similar to the footprint of the package 20 as a whole. In the example shown in FIG. 1 the flexible package material 40 defines an opening 70 which has a length dimension $L_o$ which is slightly longer than the length L of the package base. This difference may be about 2 to about 10 mm. Similarly, the example of FIG. 1 shows a package 20 in which the width of the opening $W_o$ is slightly smaller than the width W of the package 20 base. This difference may be about 2 to about 10 mm. The package 20 may be configured such that the circumference of the opening ($2\ L_o+2\ W_o$) is about equal to the circumference of the base of the package 20 (2 W+2 L).

As shown in the example of FIG. 1, the reinforcing member 50 is attached to opening 70. In the example shown in FIG. 1, the reinforcing member 50 is a comparatively rigid thermoplastic reinforcing member. By "comparatively rigid" it is meant that the rigidity of the reinforcing member is greater than that of the flexible package material 40 even though the reinforcing member 50 may yield somewhat to externally applied forces. The reinforcing member may have a rigidity which is several times greater than that of the flexible package material 40. This multiple may be 10 times, 25 times, or 50 times greater or more. It will be appreciated by those of skill in the art that such rigidity applies to the main support portions of the frame which are intended to be rigid. It is not necessary for all portions of the reinforcing member to have the same rigidity (such as the hinge elements described below), nor it is necessary for all portions of the reinforcing member to be comparatively rigid. Rigidity may be measured by the force required to bend a material through a particular distance. A comparison of the force required to bend one material versus another material the same distance is a measure of relative rigidity. One suitable manner to make such a determination is with a Material Testing Station such as INSTRON on other suitable MTS with an appropriate load cell (such as a 1000 N load cell). Samples of a material 130 mm in length (or other convenient dimension) may be deflected from 0.1 mm to 65 mm with the peak force to bend recorded. The relative force required to deflect a sample of one material this distance as compared to another gives a measure of its relative flexibility with respect to the other.

Figure 2:
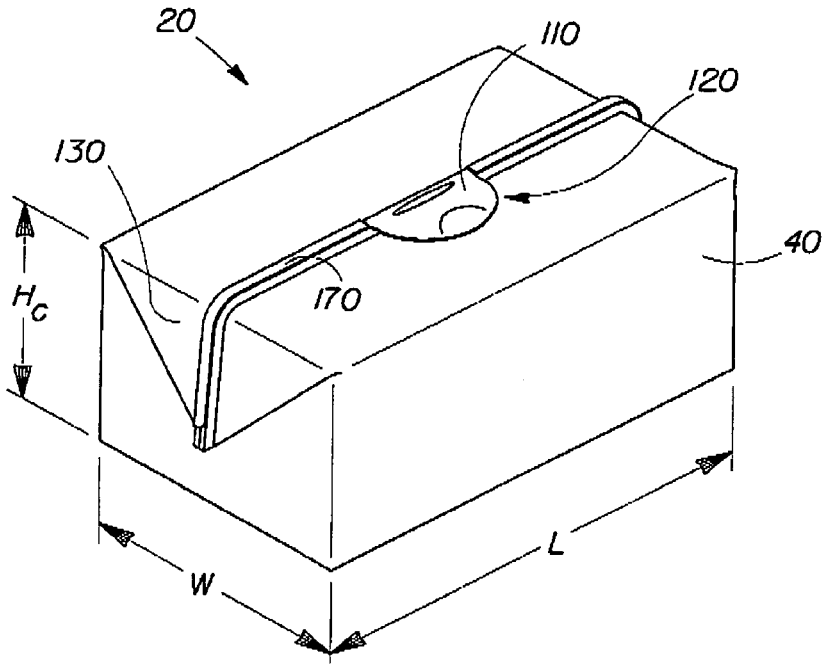
FIG. 2 shows the package of FIG. 1 in the closed configuration.

When the opening 70 dimensions are selected relative to the base dimensions in the manner shown in FIG. 1, when the package 20 is placed in a closed configuration (as shown in FIG. 2), the reinforcing member 50 will fit snugly against the sides of the package 20 and result in a closed height $H_c$ which is smaller than the open height $H_o$ of the package 20. This arrangement may be desired to provide for a package 20 which is as compact as possible during transport and storage of items such as wet wipes 30 yet which affords easy access to the contents during use in the open position. In the case of the example shown in FIGS. 1 and 2, a stack of wet wipes 30 will be snugly contained in the closed package 20 shown in FIG. 2 (at least when the stack is full). When the package 20 is opened as shown in FIG. 1, the opening 70 will extend upwardly to create a dispensing area 90 out of which wet wipes 30 can be removed.

As noted previously, the reinforcing member 50 may be formed from any suitable process such as injection molding. The reinforcing member 50 may comprise a single piece or multiple pieces joined together. In one example, a single piece reinforcing member 50 may be created with a pair of hinge elements 100 located between the two halves of the single piece. Such a hinge element 100 could be an area of weakness, reduced diameter, or the like within the reinforcing member 50 providing a defined location where the reinforcing member 50 can bend about a folding axis. The hinge elements 100 can be actual hinge structures, such as a pinned structure. It may be desired to design the reinforcing member 50 and hinge elements 100 such that the reinforcing member tends to be stable in at least a closed and near full open position. In other words, it may be desired that when the reinforcing member 50 is in the open configuration as shown in FIG. 1, it does not tend to close on its own in the absence of externally applied forces. This will allow the reinforcing member 50 to hold the opening 70 of the package 20 open for article (such as wet wipe 30) retrieval and use.

Figure 3:
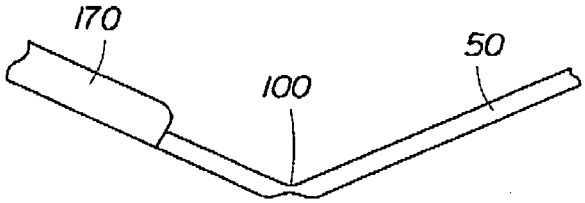
FIG. 3 shows a side view of the reinforcing member and hinge element of the package.

The reinforcing member 50 may be made from a thermoplastic material such as polypropylene or polyethylene or blends of these. The hinge elements 100 may be so called "living hinges" which are joints created by an area or zone or weakness in the reinforcing member as a whole. A detail of such a "living hinge" is shown in FIG. 3 where reinforcing member 50 is formed as a single injection molded piece with two halves connected by a "living hinge" which acts as one of the hinge elements 100. The hinge element 100 of FIG. 3 is an area of less material and preferred bending and weakness designed to allow the reinforcing member to be opened and closed multiple times throughout its life.

Figure 5:
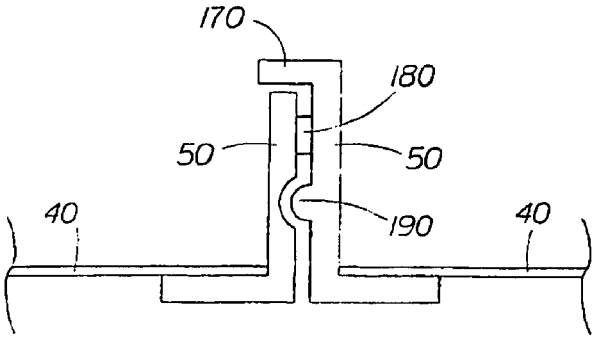
FIG. 5 shows a cross-sectional side view of a reinforcing member of a package of the present invention.

As shown in FIGS. 1 and 2, the reinforcing member 50 may be provided with a latch mechanism such as tab 110 and catch 120. The tab may be provided with a finger shaped recess or other suitable gripping portion to allow it to be easily moved with a single finger or hand. The tab 110 may have a hole, recess, or detent designed to frictionally engage with a complementary member on the other side of the reinforcing member 50, such as catch 120. When the reinforcing member is folded in the closed configuration (as shown in FIG. 2), the latch mechanism provides positive engagement keeping the package 20 in a closed configuration. The latch mechanism may be provided to give positive feedback that it is engaged. Such feedback could include an audible signal such as a "click," a colored catch such as catch 120 which is visible through a slot or groove in the tab assembly or the like. The reinforcing member 50 may be provided with a flange (such as flange 170) or lip designed to allow one side of the reinforcing member 50 to overlap the other when the package 20 is in the closed configuration. Such a feature gives the overall package 20 a pleasing closed appearance. FIG. 5 shows a cross-section of the reinforcing member 50 showing such one example of such a flange 170 configuration. Such flanges may be rectangular (e.g. squared off) or may be rounded in appearance. The reinforcing member 50 may be provided with a gasket 180 (shown in FIG. 5) to enhance the seal of the reinforcing member in the closed configuration. The gasket 180 if provided may be of a different color than the remainder of the reinforcing member to highlight its appearance. Mating grooves such as groove 190 may be provided in the reinforcing member to assist the closing and closed appearance of the package 20.

When a package 20 of the present invention (such as that shown in FIGS. 1 and 2) is well designed according to the descriptions given above it may be amenable to easy and convenient one-handed operation. A user may start with a shelf stable package 20 filled with wet wipes such as that shown in FIG. 2. Using one hand, the user could place a finger under tab 110 and open the latch mechanism. Continuing to pull on the tab 110, the reinforcing member 50 can be moved to a full open configuration such as that shown in FIG. 1. This configuration may be stable as well as previously described allowing a user to reach into the dispensing area 90 to retrieve one or more wet wipes 30 for use. In a similar manner a single hand can be used to press the sides of the reinforcing member 50 together so as to re-engage the tab 110 and catch 120 thus placing the package 20 back into a stable closed configuration.

Packages of the present invention may be openable and closable by the movement of the reinforcing member 50 itself. The reinforcing member 50 in turn moves the flexible package material 40 with it. This is in contrast to flexible films or similar wipes packages which have rigid collars and other hinge mechanisms which do not move the material of the package itself to form the top closed surface.

It has been previously described that the package 20 shown in FIG. 1 may create a dispensing area 90 when the package 20 is in an open configuration. At a simple level, this dispensing area 90 may be thought of as the space created in the open configuration and which is represented by the difference in height between $H_o$ and $H_c$. This dispensing area 90 may be created in a variety of ways. For example the sides 80 of the package 20 in the closed configuration (FIG. 2) may have a gusset 130 or folded area. Upon opening of the package 20, this gusset or folded area may open or unfold so as to extend the sides 80 in height (such as to $H_o$) to form a dispensing area 90 within the package 20. The dispensing area 90 may serve to keep the top wipe 30 or other product to be dispensed from being contaminated and may act as a "buffer zone" between the outside environment and the storage area of the package 20. If a "pop up" type dispensing system is used, the dispensing area 90 may protect the "tail" or leading edge portion of the wipe exposed through the "pop up" opening prior to its use.

The interior of the package 20 may be provided with an interior baffle such as inner baffle 60. This baffle may serve to create a physical separation between the dispensing area 90 and the storage portion of the package 20. The baffle 60 may be simply a layer of material such as a flexible thermoplastic material or may actually be an inner package structure (such as an inner "bag"). The inner baffle 60 or other inner package may be comprised of the same material as the flexible package material 40 or may comprise a different material. In one example, the baffle is attached to each of the four side walls 80 of package 80. In another example, the inner baffle 60 is attached to only two opposite side walls side as the long side walls or the end side walls. The inner baffle 60 may be provided with a dispensing orifice allowing for "pop up" or non-pop up dispensing of a single wipe or other article at a time.

Figure 4:
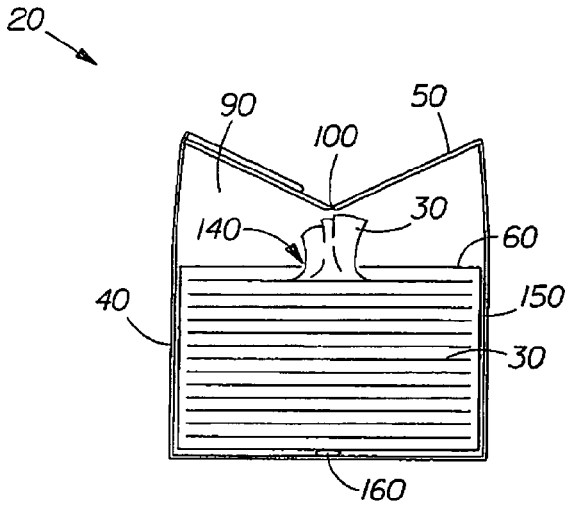
FIG. 4 shows a cross-sectional side view of a package of the present invention.
Figure 4A:
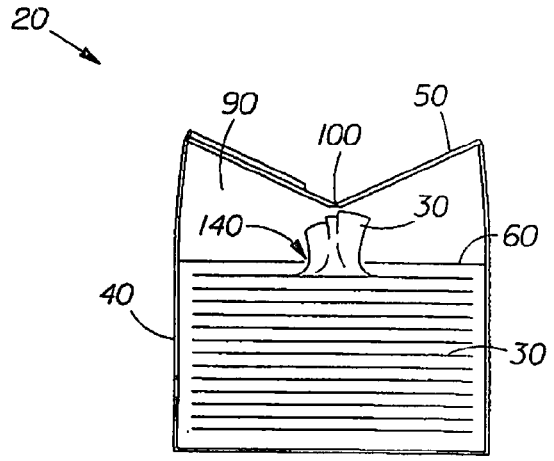
FIG. 4A shows a cross-sectional side view of a package including an interior baffle extending completely between opposed side walls of a container.

FIG. 4 shows a cross section of a variation of a package 20 of the present invention in which wet wipes 30 are dispensed through a dispensing orifice 140. This arrangement consists of an inner bag 150 disposed within the flexible package material 40. The top of the inner bag 150 serves as inner baffle 60 separating the storage area of the package 20 form the dispensing area 90. The inner baffle 60 (and inner bag as a whole) in this example is not attached to the walls of the flexible package material 40 although it could be. In the example shown in FIG. 4 the inner bag 150 is attached at its bottom 150 to the bottom of the flexible package material 40 through an attachment mechanism 160. Such a mechanism could be adhesive, an ultrasonic bond, hook and loop mechanism, thermal bond, heat bond, cohesive attachment, or any other suitable mechanism known in the art. The attachment mechanism 160 could result in a permanent bond or could be temporary—for example allowing for replacement of the inner bag 150 with replacement inner bags 150 as desired. Of course, it is not necessary to have any attachment of an inner bag 150 to the flexible package material 40 even when an inner bag is used. As mentioned above and as shown in FIG. 4A, the inner baffle 60 may also extend completely between opposed side walls of the flexable package material 40.

Although it is not necessary to do so, one possible benefit of providing a package 20 of the present invention with an inner bag such as inner bag 150 is that materials of the flexible package 40 and inner bag 150 can be different and customized for particular properties. For example, the inner bag material 150 can be selected to provide a sufficient moisture barrier when the articles to be contained and dispensed are moisture containing articles such as wet wipes. A suitable barrier to moisture escaping from such wet cleansing articles or unwanted excess moisture creeping into the packaging may have a vapor transmission rate of less than about 5 grams/$m^2$/day. If the inner bag 150 performs the vapor barrier function, the flexible package material 40 can be designed without this requirement in mind, allowing other attributes to be present. For example, the flexible package material 40 can be made more highly flexible, exhibit low noise when handled, be soft feeling and pleasant to the touch, have a low surface friction, matte-finish, be chosen with specific light reflecting, or printing surface capabilities in mind, or any combination of these attributes. While some or all of these attributes can be provided to a greater or lesser extent in a more vapor impervious film, using two bags and having the inner bag 150 meet the vapor barrier needs, provides more design latitude with respect to the flexible package material 40 itself.

The inner bag 150 can be made out of any suitable material such as polyethylene, polypropylene, blends or co-extrusions of these, or any other suitable material. Other materials suitable for use as either all or a portion of the inner bag 150 or flexible package material 140 are described in U.S. Patent Application Ser. No. 60/621,117, filed on Oct. 22, 2004.

As noted above, it is not necessary that packages of the present invention be used with wet wipes, other moisture containing personal articles, or any particular article type at all. While aspects of the present invention find usefulness in such a context, the packages of the present invention may offer shelf stable, and easy to open and close packages (such as with one hand) which may be useful in any context. Therefore, the description given above regarding wet wipes 30 or similar products which may be placed in a package of the present invention should not be taken as necessary elements of the invention.

TEST METHODS

Stiffness of Fabric Test

The Stiffness of Fabric Test is run for purpose of the present specification is a modification of the Stiffness of Fabric Test by Circular bend as described in the ASTM D 4032-94. (hereby incorporated by reference). The Stiffness of Fabric Test for purposes of the present specification is conducted as follows:

Summary of Test Method

A pusher-ball forces a swatch of material through an orifice in a platform. The maximum force required to push the fabric through the orifice is an indication of the material's stiffness (resistance to bending).

Apparatus

Circular Bend Stiffness Tester, having the following parts:

Platform, 102 by 102 by 6 mm smooth-polished chrome-plated steel plate with a 38.1-mm diameter orifice. The lap edge of the orifice should be at a 45° angle to a depth of 4.8 mm.

Pusher-Ball, 6 mm diameter steel spherical ball, mounted concentric with orifice, 16 mm clearance on all sides. The bottom of the pusher-ball plunger should be set at 3 mm above the top of the orifice plate. From this position, the downward stroke length is 57 mm.

Force-Measurement Gage, dial or digital type Dial gages with maximum reading pointer in different capacities ranging from 1 to 50 lbf, 0.5 to 25 kgf, or 5 to 200 N with 100 graduations minimum; or Digital gage with maximum reading "hold" feature and capacity of 100 lbf, 50 kgf, or 500 N, with 1000 graduations minimum.

Actuator, manual or pneumatic.

Specimen Marking Template, 102 by 102 mm.

Stop Watch, for checking stroke speed.

Number and Preparation of Test Specimens

Using the specimen marking template specified above mark and cut five test specimens from staggered areas of each swatch of material to be tested. It will be appreciated that it not be practical or possible to obtain all samples from a particular swatch (or particular product if the material is only available as incorporated into a product). In such a case, it is acceptable to take samples from multiple products or swatches. Samples with bonded, seals, seams or the like should be avoided. Lay each specimen face to form a square 102 by 102 mm. Handling of specimens should be kept to a minimum and to the edges to avoid affecting stiffness properties.

Conditioning

Condition the samples for 8 hours or more at 23° C. and 50% relative humidity.

Procedure

Set the tester on a flat surface with dial at eye level.

Select a gage with a capacity in which results will fall within 15 to 100% of dial gage force or 1.5 to 100% of digital gage force.

Check tester pusher-ball speed control for full stroke length.

Pneumatic Actuator—Set the air pressure control to the actuator at 324 kPa. Using a stop-watch, adjust the pneumatics to provide plunger speed of 1.7±0.15 s under no load conditions.

Manual Actuator—Using a stop-watch, establish and confirm a plunger speed of 1.7±0.3 s.

Center a specimen on the orifice platform below the pusher-ball.

If 3.2 mm clearance under pusher-ball prevents ease of entry of specimen due to sample thickness, the clearance may be increased to 6.3 mm maximum. In reporting, the results should indicate the pusher-ball clearance, if not standard.

Check the gage zero and adjust, if necessary.

Set the maximum force reading switch.

Actuate the pusher-ball for the full stroke length. Avoid touching the specimen during testing.

Record maximum force reading to nearest gage graduation.

Continue as directed above until all specimens have been tested.

Calculation

Average the individual specimen readings and round to the nearest gage increment.

Report

Report the Average force in gage units.

End of Test

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package comprising:

a highly flexible bag material for containing one or more articles, said bag material defining a shelf stable bag having a bottom surface, 4 side surfaces, and a top opening portion, wherein the bottom surface is a rectangular shape defined by a length L and width W and a bottom circumference of 2L+2W, and the top opening portion is a rectangular shape defined by a length $L_O$ and a width $W_O$ and a top opening circumference of $2L_O+2W_O$, and wherein $L_O$ is greater than L and $W_O$ is less than W and wherein the bottom circumference is about equal to the top opening circumference;

a relatively rigid reinforcing member attached to said highly flexible, shelf stable bag material around the top opening circumference of said top opening portion, said reinforcing member being a single piece having opposed first and second sides and opposed third and fourth sides defining a rectangular shape in an open configuration, the third and fourth sides each including areas having relatively less material in the relatively rigid reinforcing member defining areas of weakness, wherein the relatively rigid reinforcing member is adapted to bend at the areas of weakness to transition from the open configuration to a closed configuration, said reinforcing member keeping said top opening portion of said bag in a stable open position when said reinforcing member is in said open configuration, said reinforcing member being configured such that a user can with one hand transition said reinforcing member from said open configuration to said closed configuration and from said closed configuration to said open configuration, said bag material and said reinforcing member being configured such when said reinforcing member is in said closed configuration said opposed first and second sides of said reinforcing member abut to define a closed top portion of said bag, thereby resulting in a stable closed state for said package.

2. The package of claim 1 wherein said relatively rigid reinforcing member has at least 10 times the resistance to bending as said flexible bag.

3. The package of claim 2 wherein said relatively rigid reinforcing member has at least 25 times the resistance to bending as said flexible bag.

4. The package of claim 3 wherein said relatively rigid reinforcing member has at least 50 times the resistance to bending as said flexible bag.

5. The package of claim 1 wherein said highly flexible bag material has a stiffness measured under the Stiffness of Fabric test of less than about 1000 $g_f$.

6. The package of claim 5 wherein said highly flexible bag material has a stiffness measured under the Stiffness of Fabric test of less than about 500 $g_f$.

7. The package of claim 5 wherein said highly flexible bag material has a stiffness measured under the Stiffness of Fabric test of less than about 250 $g_f$.

8. The package of claim 1 wherein said rigid reinforcing member further comprises a latch mechanism.

9. The package of claim 8 wherein said latch mechanism comprises a catch adapted to engage a tab when transitioning from said open to said closed position.

10. The package of claim 9 wherein the catch is visible through a slot in the tab to provide a visual signal indicating transition from said open to said closed position.

11. The package of claim 1 wherein said relatively rigid reinforcing member is formed as a single injection molded piece comprising thermoplastic material.

12. The package of claim 11 wherein said rigid reinforcing member comprises a material chosen from group consisting of polyethylene, polypropylene, and blends thereof.

13. The package of claim 1 wherein said highly flexible bag material is constructed from a single piece of a thermoplastic material.

14. The package of claim 13 wherein said thermoplastic material comprises a material chosen from the group consisting of polyethylene, polypropylene, and blends thereof.

15. The package of claim 1 wherein the areas of weakness are disposed adjacent said side surfaces of said bag when said rigid reinforcing member and said bag are in said closed configuration.

16. The package of claim 1 wherein said relatively rigid reinforcing member is provided with a flange element wherein at least a portion of said flange element overlaps at least a portion of said reinforcing member when said reinforcing member is in said closed position.

17. A package of moisture containing cleansing articles comprising:

a stack of moisture containing cleansing articles, the stack having a stack height H;

a flexible package material substantially surrounding the stack of moisture containing cleansing articles, the package material defining a container having 4 side surfaces, a bottom surface, and a top opening, wherein the bottom surface is a rectangular shape defined by a length L and width W, and the top opening is a rectangular shape defined by a length $L_O$ and a width $W_O$, and wherein $L_O$ is greater than L and $W_O$ is less than W, the container defining a first height $H_O$ in the open configuration and a second height $H_C$ in the closed configuration and wherein $H_O$ is greater than $H_C$, and wherein the second height $H_C$ is substantially the same as the stack height H;

an inner wrapper containing the stack of moisture containing cleansing articles, the inner wrapper being disposed within the container defined by the flexible package material;

an attachment mechanism releasably connecting the inner wrapper to the container;

a relatively rigid reinforcing member attached to the flexible package material around the perimeter of the top opening, the reinforcing member being a single piece having opposed first and second sides and opposed third and fourth sides defining a rectangular shape in an open position, the third and fourth sides each including areas having relatively less material in the relatively rigid reinforcing member defining areas of weakness, wherein the relatively rigid reinforcing member is adapted to bend at the areas of weakness to transition from the open configuration to a closed position, the reinforcing member keeping the top opening portion of the container bag in a stable open configuration when the reinforcing member is in the open position, the reinforcing member being configured such that a user with one hand can transition the reinforcing member from the open position to the closed position and from the closed position to the open position, the container and the reinforcing member being configured such when the reinforcing member is in the closed position the flexible package material and the reinforcing member define a closed container resulting in a stable closed state for the package of moisture containing cleansing articles.

18. The package of claim 17 wherein when said reinforcing member is in said open position, said flexible package material defines a dispensing area disposed generally above the stack of moisture containing cleansing articles.

19. The package of claim 18 further comprising an interior baffle generally partitioning the stack of said moisture containing cleansing articles from said dispensing area.

20. The package of claim 19 wherein said interior baffle is connected with opposed side walls of said container defined by said flexible package material.

21. The package of claim 19 wherein said interior baffle does not extend completely between opposed side walls of said container defined by said flexible package material.

22. The package of claim 17 wherein the attachment mechanism comprises a hook and loop mechanism.

23. The package of claim 22 wherein said inner wrapper has a vapor transmission rate of less than or equal to about 5 $g/m^2/day$.

24. The package of claim 22 wherein the attachment mechanism releasably connects the inner wrapper to the flexible package material along the bottom of the container.

25. The package of claim 17 wherein said reinforcing member defines a circumference in said open position which is substantially equal to or greater than the circumference of said bottom surface of said container defined by said flexible package material.

26. The package of claim 17 wherein at least portions of said reinforcing member are disposed generally adjacent two or more of said side surfaces of said container defined by said flexible package material when said reinforcing member is in said closed position.

27. The package of claim 17 wherein said reinforcing member is provided with a flange element wherein at least a portion of said flange element overlaps at least a portion of said reinforcing member when said reinforcing member is in said closed position.

28. The package of claim 17 wherein said reinforcing member further comprises a latch mechanism.

29. The package of claim 28 wherein said latch mechanism comprises a catch adapted to engage a tab when transitioning from the open to closed position.

30. The package of claim 29 wherein the catch is visible through a slot in the tab to provide a visual signal indicating transition from the open to closed position.

31. The package of claim 17 wherein said reinforcing member is formed as a single piece of thermoplastic.

32. The package of claim 31 wherein said reinforcing member is made from a material chosen from the group consisting of polyethylene, polypropylene, and blends thereof.

33. The package of claim 17 wherein said flexible package material is constructed from a single piece of thermoplastic.

34. The package of claim 17 wherein said flexible package material is made from a material chosen from the group consisting of polyethylene, polypropylene, and blends thereof.

35. The package of claim 17 wherein said moisture containing cleansing articles are wet wipes.

36. The package of claim 17 wherein said highly flexible bag material has a stiffness measured under the Stiffness of Fabric test of less than about 1000 $g_f$.

37. The package of claim 17 wherein said highly flexible bag material has a stiffness measured under the Stiffness of Fabric test of less than about 500 $g_f$.

38. The package of claim 17 wherein said highly flexible bag material has a stiffness measured under the Stiffness of Fabric test of less than about 250 $g_f$.

39. The package of claim 17 wherein said relatively rigid reinforcing member has at least 10 times the resistance to as said flexible bag.

40. The package of claim 17 wherein said relatively rigid reinforcing member has at least 25 times the resistance to bending as said flexible bag.

41. The package of claim 17 wherein said relatively rigid reinforcing member has at least 50 times the resistance to bending as said flexible bag.

42. A package of moisture containing cleansing articles comprising:

a stack of moisture containing cleansing articles, the stack having a stack height H;

a first flexible inner package material substantially surrounding the stack of moisture containing cleansing articles, the first flexible inner package material having a vapor transmission rate of less than or equal to about 5 $g/m^2/day$;

a second flexible outer package material defining a container including a bottom side and four side walls extending upward from the bottom side to define a perimeter of an opening, the bottom side defined by a length L and width W;

a means for releasably connecting the first flexible inner package material to the container and allowing for removal and replacement of the first flexible inner package material;

wherein the container is adapted to be selectively configured between an open configuration and a closed configuration, the container defining a first height $H_O$ in the open configuration and a second height $H_C$ in the closed configuration and wherein $H_O$ is greater than $H_C$, wherein the bottom side is a rectangular shape and the perimeter of the opening is a rectangular shape defined by a length $L_O$ and a width Wo, and wherein $L_O$ is greater than L and $W_O$ is less than W;

a relatively rigid reinforcing member connected along a perimeter of the opening, the relatively rigid reinforcing member being a single piece including opposing first and second sides and opposing third and fourth sides defining a rectangular shape in the open configuration, the third and fourth sides each including areas having relatively less material in the relatively rigid reinforcing member defining areas of weakness, wherein the relatively rigid reinforcing member is adapted to bend at the areas of weakness when transitioning from the open configuration to the closed configuration;

wherein the second flexible outer package material substantially surrounds the first flexible inner package material when the container is in the closed configuration, the second flexible outer package material having a vapor transmission rate in excess of that of the first inner package material; and wherein the $H_C$ is substantially the same as the stack height H such that the stack of moisture containing cleansing articles are snugly contained within the container when in the closed configuration.

* * * * *